United States Patent [19]

D'Andrade

[11] 4,406,084

[45] Sep. 27, 1983

[54] TOY CAR WITH RUBBER BAND MOTOR

[75] Inventor: Bruce M. D'Andrade, Whitehouse Station, N.J.

[73] Assignee: Arco Industries Ltd., Hong Kong, Hong Kong

[21] Appl. No.: 369,892

[22] Filed: Apr. 19, 1982

[51] Int. Cl.[3] ..... A63H 17/00

[52] U.S. Cl. ..... 46/208; 46/206

[58] Field of Search ..... 46/206, 208, 202, 201, 46/209, 93; 185/39, 9, 10, DIG. 1

[56] References Cited

U.S. PATENT DOCUMENTS

| | | | |
|---|---|---|---|
| 1,914,438 | 6/1933 | Labin | 46/206 |
| 2,749,660 | 6/1956 | Zimentstark | 46/206 |
| 3,216,529 | 11/1965 | Lohr | 185/39 |
| 3,229,415 | 1/1966 | Bross | 46/206 X |
| 3,698,129 | 10/1972 | Lemelson | 46/202 |
| 3,757,459 | 9/1973 | Buck et al. | 46/206 X |
| 3,769,746 | 11/1973 | Prodger et al. | 46/206 |
| 3,919,804 | 11/1975 | Nakata | 46/206 |

FOREIGN PATENT DOCUMENTS 477769 1/1938 United Kingdom .

*Primary Examiner*—Mickey Yu

*Attorney, Agent, or Firm*—C. Hercus Just

[57] ABSTRACT

A toy automobile having front and rear axles on a body respectively supporting wheels, one of the axles being driven by a gear train energized by a twisted elongated member such as a rubber band, the elastic member being energized by twisting it by means of a reciprocable elongated rack extendable axially in opposite directions relative to the body of the automobile, which rack when pulled outwardly actuating the gear train to wind a drive shaft for the elastic member and, when the rack is pushed in retraction into the body, a throwout gear in the train is disconnected to prevent unwinding the elastic member, and a manually operable stop member engages the drive axle to prevent movement thereof until released.

10 Claims, 5 Drawing Figures

10
12
14
16
18
20
34
36
38
40
42
56
72
74
76
78
80
82
84
86
88
90
94
96
100
110
2
2

10
14
16
18
20
22
26
32
34
36
38
40
42
54
56
60
62
64
66
82
94
96
100
1
1
3
3

20
34
36
42
62
72
78
80
82
86
90
92
94
100
4
4

TOY CAR WITH RUBBER BAND MOTOR

BACKGROUND OF THE INVENTION

The present invention pertains to a toy vehicle such as an automobile in which pairs of wheels mounted respectively adjacent the forward and rearward ends thereof support the vehicle and the axle of one of said pairs of wheels is driven by a motor which is energized by an elongated elastic member, such as a rubber band, which is twisted by means described hereinafter in order to rapidly twist the elastic member sufficiently to provide appropriate energy to drive the vehicle for a substantial distance by means of a gear train, all of which are described in detail hereinafter.

A number of toy vehicles such as automobiles and the like are available in which the wheels are driven by suitable small electric motors energized by dry batteries which, depending upon the amount of use, can require frequent replacement. Other types of toy vehicles have been designed however which are powered by means other than electric motors, especially to save replacement costs, some of these including coiled spring motors which are coiled or otherwise energized in various ways. Typical examples of spring motored toy vehicles comprising the subject matter of prior U.S. Pat. Nos. 3,216,529 to Lohr, dated Nov. 9, 1962, and 3,919,804 to Nakata, dated Nov. 18, 1975. Both of these patents use a toothed rack which drives appropriate gearing to coil the spring. Another type of spring operated toy vehicle is the subject matter of prior U.S. Pat. No. 1,914,438 to Labin, dated June 20, 1933, in which a tensioned spring is adapted to be stretched by pulling a spiral rod in one direction and, upon releasing the rod, the coil spring pulls the spiral rod in retracting direction through a slot in a drive gear which actuates a pinion gear on an axle of the vehicle to drive the same.

Prior patents also disclose toy vehicles in which the power means comprises a rubber band which is capable of being twisted. For example, in prior U.S. Pat. No. 2,749,660 to Zimentstark, dated June 12, 1956, a twisted rubber band drives a ring gear associated with a pinion on the drive axle of the vehicle, the rubber band being twisted by a manually operated key which comprises a relatively slow means for twisting the rubber band. Still another similar U.S. Pat. No. 3,769,746 to Prodger et al uses a rubber band which is twisted by means of rotating a simulated spare tire on the rear end of the vehicle capable of having the rim thereof move in frictional engagement with the surface to rotate the same and thereby twist the rubber band.

Stil another type of supplying energy to a toy vehicle is the subject matter of prior U.S. Pat. No. 3,698,129 to Lemelson, dated Oct. 17, 1972, in which an inertia wheel is mounted in driving relationship to the rear axle of the vehicle, the inertia wheel being set in motion by means of a rack movable transversely from one side of the vehicle to rotate a gear associated with the inertia wheel.

Still another type of rubber band motor mechanism is disclosed in prior British Pat. No. 477,769 to Lobb, London, England, dated Jan. 3, 1938, in which the rubber band motor is mounted in a boat and is adapted to be twisted by a spiral rod moved longitudinally with respect to gear mechanism while the propeller is held stationary by a stop lever, and when the rubber band is twisted sufficiently, the stop lever is released and the twisted rubber band drives the propeller.

The present invention includes simple but highly effective means for driving a toy vehicle by means of a twisted elongated elastic member, such as a rubber band which is adapted to be coiled by mechanism not suggested in detail in the foregoing art and it is believed that the construction comprises improvements thereover, details of the invention being set forth below.

SUMMARY OF THE INVENTION

It is among the principal objects of the invention to provide a toy vehicle such as examplified by an automobile having a body supported by a pair of axles on which wheels are mounted respectively opposite adjacent ends thereof and one of said axles being driven by gear mechanism energized by an elongated elastic member fixed at one end to one end of the body of the vehicle and the opposite end being connected to a short drive shaft which is interconnected to gear mechanism which serves a dual purpose, one purpose being to drive said aforementioned driven axle of the vehicle and the other being to twist the elastic member to energize it by means of an elongated rack which coacts with one of the gears of the gear train to effect such twisting of the elastic member.

Another object of the invention is to provide in the gear train a throwout gear supported in a pair of short, transversely aligned slots in a supporting frame for the gear structure, whereby the gear is adapted for engagement and disengagement with a drive gear fixed to the driven axle and arranged in such manner that when the elongated rack is pulled outwardly from a retracted position in the body of the vehicle, the throwout gear is engaged with the drive gear and rotates the same for movement of the wheels thereon in rearward direction while incidentally twisting the elastic member and, conversely, when the rack is pushed inwardly preliminarily to conditioning it for another outward pull, such pushing of the rack disengages said throwout gear from the drive gear but stop means are employed with respect to the driven axle for purposes of preventing forward movement thereof and undesired untwisting of the twisted elastic member incident to the same being twisted to the fullest desired extent before releasing the driven axle for forward movement of the wheels thereon as driven by untwisting of the elastic member.

A further object of the invention is to employ a ring gear upon one end of the short drive shaft for engagement with a transfer gear supported upon the driven axle for free rotation thereon and limited axial movement while remaining in engagement with the ring gear, and clutch means of a ratchet nature being mounted between said drive gear and transfer gear in such manner that the clutch is in engagement when the rack is pulled outwardly to twist the elastic member by means of rotation of said short drive shaft but, when the untwisting of the elastic member has occurred to such extent that its power is substantially spent, the members of said clutch are arranged to ratchet with respect to each other to permit the vehicle to coast after the driving energy has been expended, such ratcheting of the clutch being permitted by virtue of limited axial movement of the transfer gear occurring against the action of a relatively weak spring normally engaging said transfer gear to urge the ratchet members of the clutch into operative engagement.

Still another object of the invention is to mount the relatively simple gear train in a supporting frame comprising at least a pair of parallel side plates in which bearings for the driven axle are located as well as said short aligned slots for the throwout gear, said throwout gear being mounted upon a second shaft which is parallel to the driven axle and the opposite ends of which are disposed in said aligned slots, said supporting frame also including end plates connected to opposite ends of the side plates of said frame, said end plates having guide openings through which the rack extends in slideable relationship with one edge of said openings, while a pinion fixed relative to the throwout gear is continuously in engagement with said rack and prevents the same from moving out of slideable engagement with said aforementioned edges of said openings in the end plates, the rack also having an operating knob on the outer end thereof and the inner end having a stop member engageable with the forward end plate of said supporting frame to stop the movement of the rack in pulling direction when the elastic member is being twisted.

Still another object of the invention is to provide in said supporting frame a pair of spaced bearings within which longitudinally spaced portions on short drive shaft are mounted, the forward end of said drive shaft having means to which one end of the elastic member is connected and the opposite end of said drive shaft being connected to said ring gear which drivingly engages said transfer gear when the vehicle is moving forwardly as driven by the untwisting movement of the elastic member.

A still further object of the invention is to include spring means normally operable to urge the aforementioned shaft upon which the throwout gear is mounted forwardly to tend to disconnect the throwout gear from the drive gear on the driven axle, thereby supplementing the tendency of the pushed movement of the rack to disconnect said gear.

Still another object of the invention is to provide a stop member on the toy automobile in the form of a lever pivotally supported intermediately of the ends thereof and having one end extending through a slot in the body of the toy for manual engagement and the opposite end being engageable with a ratchet type notched rotary stop member fixed to the driven axle and comprising a pair of cam-shaped members having short abutments engageable with said opposite end of the stop lever when the rack is being pushed forwardly for purposes of holding the driven axle and twisted elastic member stationary during such forward movement of the rack, and said cam-shaped surfaces on said stop member on the axle causing a somewhat ratchet-like engagement with said stop lever when the rack is being pulled outwardly to operate the gear train to twist the elastic member, and spring means being connected to said lower end of the stop lever to maintain the terminal portion of said lower end either in abutment with the abutments on said rotatable stop member or cam surfaces associated therewith.

Still another object of the invention ancillary to the immediately foregoing object is to provide a snap-acting detent arrangement with the upper end portion of the stop lever to hold the same in retracted position with the lower end of the lever out of engagement with the rotatable stop member on the driven axle when the vehicle is being driven forwardly by untwisting movement of the elastic member to drive the gear train and driven axle in a direction to move the vehicle forwardly.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENT OF THE INVENTION

Figure 1:
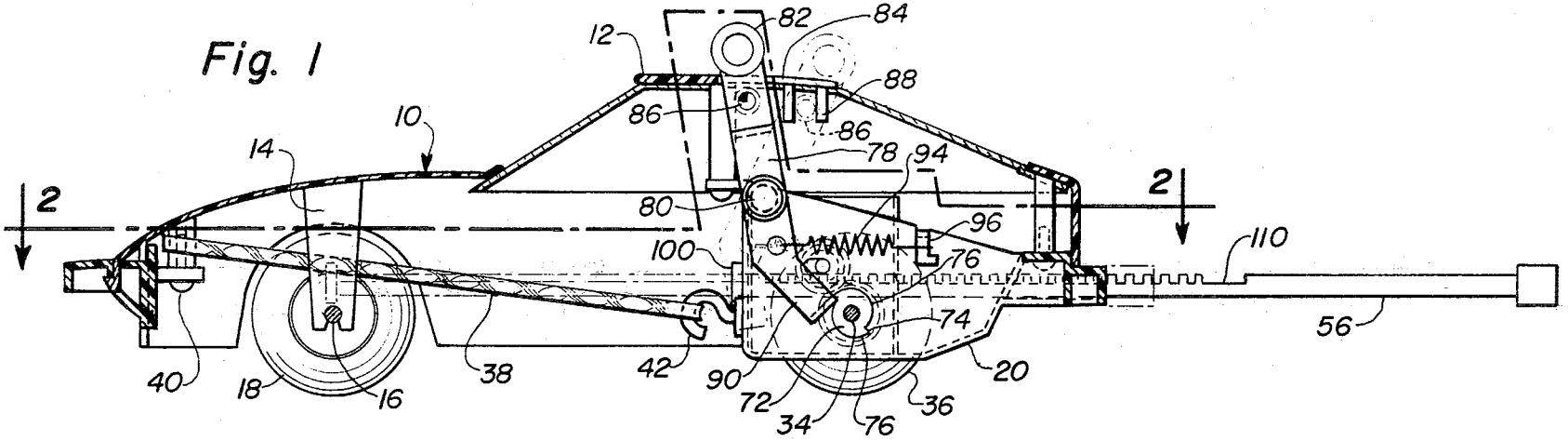
FIG. 1 is a vertical section view of an exemplary toy vehicle embodying the principles of the present invention and showing certain movable members thereof respectively in full line and phantom illustrations to represent various positions thereof, the section of the figure being taken on the line 1—1 of FIG. 2.
Figure 2:
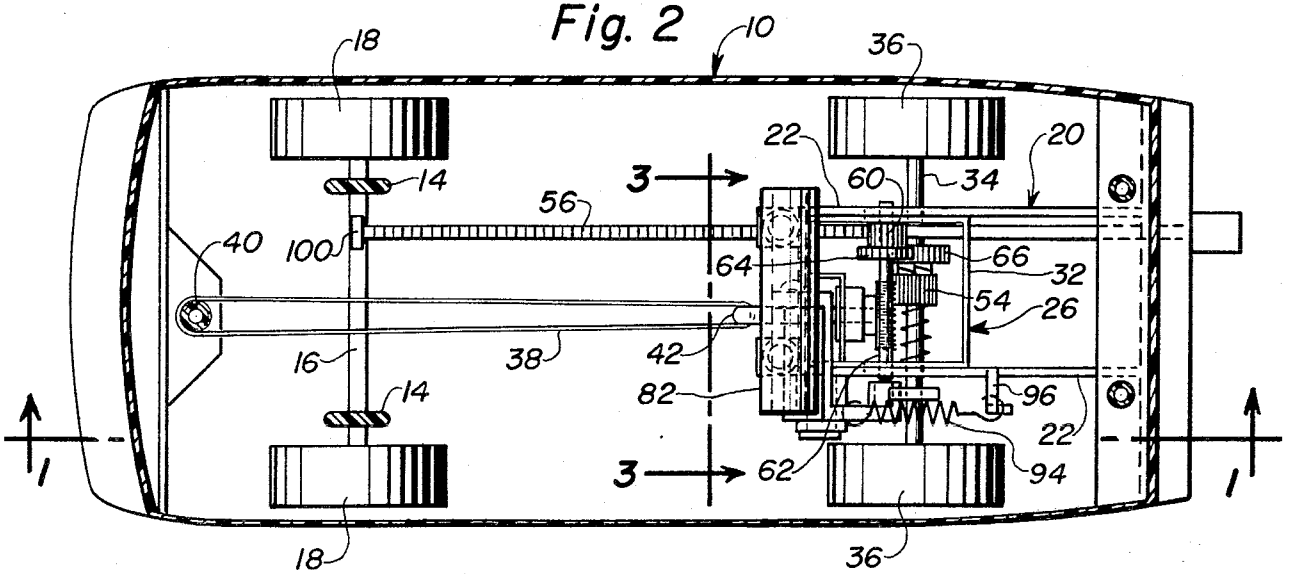
FIG. 2 is a horizontal sectioned view, somewhat in plan, as seen on the irregularly shown line 2—2 of FIG. 1.
Figure 3:
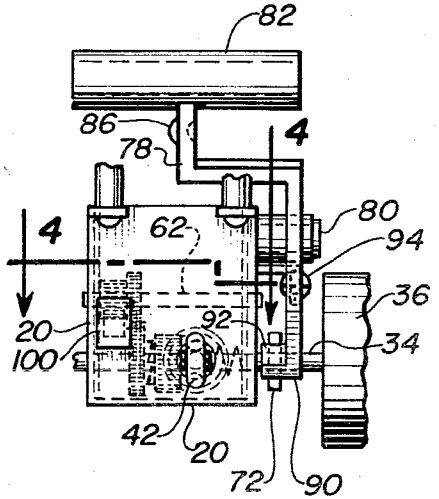
FIG. 3 is a fragmentary vertical section view showing gear train and stop mechanism of the invention as seen on the line 3—3 of FIG. 2.

Referring particularly to FIGS. 1 and 2, it will be seen that the present invention pertains to a toy vehicle of the wheeled type and including a body 10 which may consist of two or more shell-like members preferably formed by molding from suitable plastic material but it will be understood that the same may also be shaped from metal, paper fiberboard or the like, as desired. The body comprises a top 12 and the forward portion of the shell includes a pair of struts 14 which extend downwardly to rotatably support a front axle 16 on the opposite ends of which wheels 18 are mounted for free rotation relative to the body.

Figure 4:
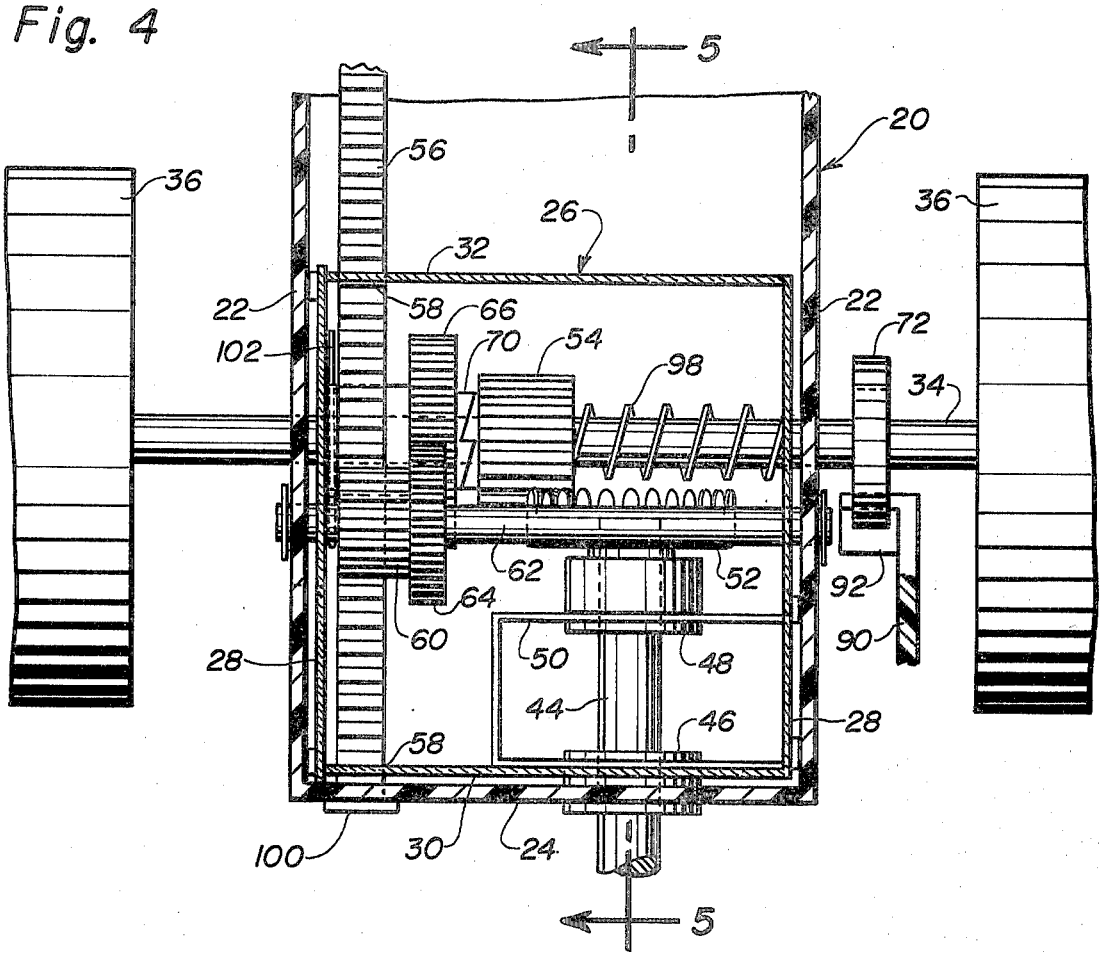
FIG. 4 is an enlarged fragmentary horizontal section showing in greater detail elements of the structure shown in FIG. 3 as shown on the lines 4—4 thereof.

The rear portion of the body 10 includes a preferably molded housing 20 which is somewhat cup-shaped, the bottom thereof being lowermost and said housing may be molded from plastic material, or otherwise stamped from metal and having opposite sides 22 which are parallel to each other as shown best in FIG. 4. There also is a front wall 24 integral with the side walls. Disposed within the housing 20 is what is illustrated as a rectangular supporting frame 26 shown in horizontal section in FIG. 4 and in vertical section in FIG. 5, the rectangular supporting frame 26 having side plates 28 which are relatively close to the opposite sides 22 of housing 20, as shown in FIG. 4, and although the rectangular supporting frame 26 preferably is made from sheet metal, it also may be molded from plastic or other suitable material. The supporting frame 26 also has parallel end plates 30 and 32. The opposite sides 22 of housing 20 and side plates 28 of the frame 26 have axially aligned bearing openings therein which rotatably support driven axle 34 which extends in opposite directions from housing 20 and drive wheels 36 are fixedly connected to the opposite ends of axle 34.

Figure 5:
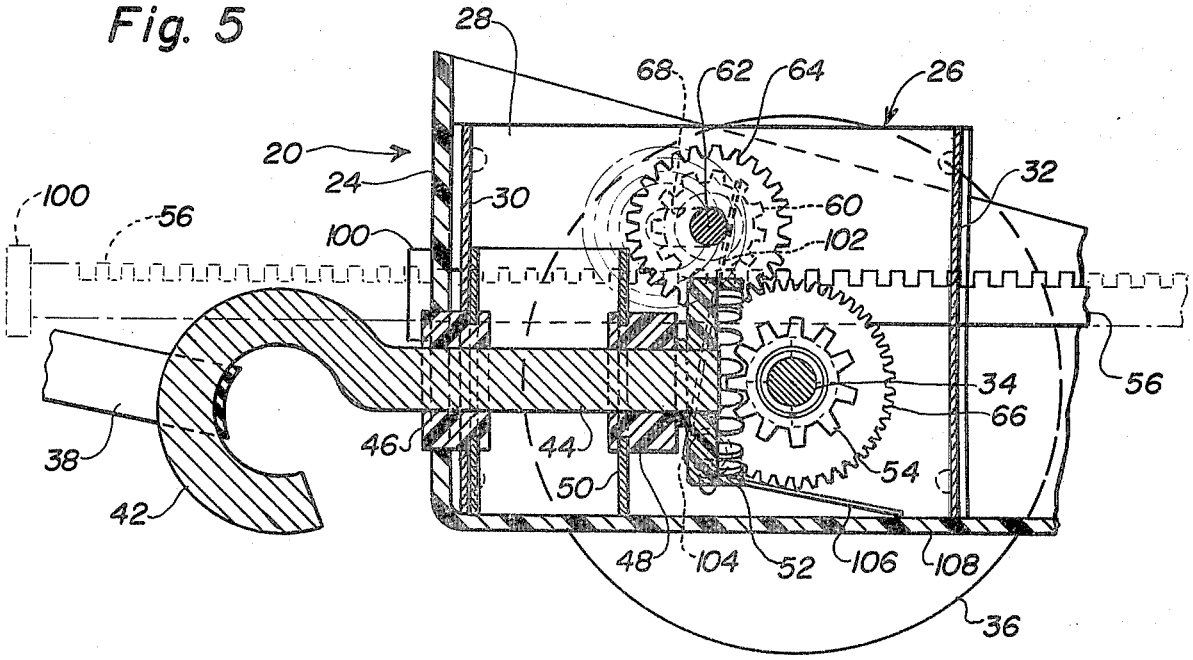
FIG. 5 is a longitudinal vertical section view of the mechanism shown on FIG. 4 as seen on the line 5—5 thereof.

An elongated elastic member 38 comprises at least one, or a plurality if desired, of rubber bands of suitable strength and durability, one end of member 38 being anchored to a fixed member 40 preferably supported in the forward end of the body 10 and extends rearwardly for connection to the forward end 42 of a short drive shaft 44, the end 42 preferably being in the form of a hook as shown in FIG. 5 and the shaft 44 is rotatably supported in fixed bearings spaced longitudinally along said shaft, bearing 46 being disposed in suitable apertures in front wall 24 of housing 20 and end plate 30 of supporting frame 26. Bearing 48 is mounted within a supplemental plate 50 which is parallel to but spaced rearwardly from the end plate 30 of supporting frame 20 as best shown in FIGS. 4 and 5, the supplemental plate 50 being suitably connected to the supporting frame 26 by any suitable means such as bent ears, rivets or otherwise. The rearward end of drive shaft 44 is fixedly connected to a driven gear 52 which, as best shown in FIGS. 4 and 5, preferably is a ring gear having teeth extending rearwardly relative to and parallel with the drive shaft 44, said teeth engaging the teeth of a pinion-like transfer gear 54 which is mounted for free rotation upon driven axle 34 and also arranged for limited axial movement upon said axle and the length of the transfer gear 54 being sufficient, as shown in FIG. 4, to continue to engage the teeth of the driven gear 52 during all such limited axial movement of the gear 54 upon axle 34.

Twisting of the elongated elastic member 38 is accomplished by an elongated toothed rack 56, the preferred arrangement thereof being that the teeth of the rack are on the upper surface thereof and said rack extends through suitable openings 58 and 60 respectively formed in end plates 30 and 32 and the lower surface of the rack slideably engages the bottom edge of said openings. In order to prevent the teeth of the rack from engaging the upper edges of the openings, a driving pinion 60 rotatably engages the teeth of the rack 56 and thereby cooperates with the openings 58 and 60 to provide appropriate guide means for longitudinal movement in opposite directions of the rack 56.

The supporting frame 26 contains a gear train of relatively simple nature, one of said gears comprising the driving pinion 60 which is fixed to a second shaft 62 which also extends through appropriate bearing openings respectively in the side walls 28 of supporting frame 26 and the opposite sides 22 of the housing 20 and such shaft is parallel to the driven axle 34. Also fixed to shaft 62 is a throwout gear 64 which preferably is immediately adjacent the driving pinion 60, the throwout gear 64 being operable to engage and disengage drive gear 66 which is fixed to the driven axle 34 and is in the plane common with the throwout gear 64. For purposes of qualifying the gear 64 as a throwout gear, the openings through which the second shaft 62 extend in the side members and side walls referred to above are in the form of similar, transversely aligned short slots 68, best shown in FIG. 5, said slots preferably being substantially horizontal and permitting forward and rearward movement of the throwout gear 64 respectively for disengagement from and engagement with the drive gear 66.

Disposed between transfer gear 54 and drive gear 66, as shown in FIG. 4, is a ratchet-type clutch 70 respectively having ratchet teeth extending from one face of the drive gear 66 and additional, coengageable ratchet teeth extending from the face of transfer gear 54 nearest gear 66, said coengageable ratchet teeth respectively comprising members of said clutch.

Stop means for the driven axle 34 are provided in the form of a rotatable stop member 72, see FIGS. 1 and 4, which is fixed to driven axle 34 and includes a plurality of abutment faces 74, see FIG. 1, between which cam surfaces extend. The stop means also includes a lever 78 pivotally supported intermediately of its ends upon a pivot 80 mounted on side 22 of housing 20, for example. The upper end of lever 78 terminates in a manually engageable handle 82, the top 12 of the body 10 having a slot 84 through which the upper end of lever 78 extends. Also, as seen in FIG. 1, there is a latching detent 86 projecting therefrom for engagement between a pair of lugs 88 adjacent one side of and below the slot 84 in the top 12 in order that the detent 86 may snap between the same as shown in phantom in FIG. 1. The lower end 90 of lever 78 has a lateral extension 92 which is slideably engageable with the cam surfaces 76 of rotatable stop member 72 and also are adapted to engage the abutment 74 on member 72 when rotation of driven axle 34 is to be prevented in circumstances described below. The extension 92 is maintained in engagement with stop member 72 at all times however by means of a spring 94 which extends between the lower portion of lever 78 and at abutment 96 on housing 20 as shown in FIG. 1.

A relatively weak spring 98 surrounds the driven axle 34, as shown in FIG. 4, and opposite ends thereof respectively abut one face of the transfer gear 54 and the inner surface of side plate 28 of the supporting frame 26 and the purpose of said spring is to normally, at least lightly, maintain the ratchet elements of the clutch 70 in engagement with each other or permit ratcheting movement, as desired or required, in accordance with the operation of the drive and winding mechanism, which is described in detail as follows.

In the rest position, the rack 56 normally is extended into the body of the toy automobile, such as to the full extent. For purposes of twisting the elastic member 38 to energize the same for purposes of driving the gear train to propel the toy automobile forwardly, the rack 56 is pulled rearwardly, preferably to the full position thereof shown in FIG. 1, which movement is limited by a stop 100 fixed to the innermost end of the rack and abutable against the front wall 24 of housing 20 for example, as shown in FIG. 5. During such rearward movement, the rack engages driving pinion 60 and rotates the same together with throwout gear 64 which is then in mesh with drive gear 66 due to the rotative movement of the throwout gear 64 tending to move the second shaft 62 to the rearward ends of the supporting slots 68, thereby meshing the throwout gear 64 with the drive gear 66, the rotation of the drive gear being in such direction as to cause the ratchet members of the clutch 70 to drivingly engage each other, correspondingly to rotate the transfer gear 54 which is in engagement with the ring-type driven gear 52 connected to the short drive shaft 44, which thereby is rotated to impart twisting movement to the elastic member 38. During such movement, the drive gear 66 is rotated as stated above, and this causes the driven axle 34 to be driven in a direction to rotate the wheels 36 reversely to forward motion and during the time this occurs, the abutment 92 of stop lever 78 is ratcheting with respect to the cams 76 and abutments 74 on rotatable stop member 72 due to the retaining action of spring 94 acting upon the lower end of the lever 78. Upon the completion of such pulling or withdrawal movement of the rack 56, said rack then is pushed forwardly, to the full extent if desired, and such movement initially causes the throwout gear 64 to be moved forwardly with respect to the slots 68 and thereby disengage the throwout gear from the drive gear 66 but during such forward pushing movement of the rack 56, no untwisting of the partially twisted elastic member occurs due to the abutment 92 of the lever 90 engaging one of the abutments 74 which prevents rotation of the driven axle 34 by the short drive shaft 44 and the gears 52 and 54 extending between said drive shaft and axle 34. However, when the elastic member 38 has been twisted to the desired extent, the lever 38 is moved from the full line position shown thereof in FIG. 1 to the phantom position for purposes of disengaging the detent 92 of the lever from the stop member 72, whereby the untwisting movement of elastic member 38 revolves drive shaft 74 to cause ring gear 52 to drive transfer gear 54 in driving direction with respect to the axle 34 and also revolving drive gear 66 therewith but the same is out of engagement with the throwout gear 64.

When the toy has been driven forwardly to the full extent afforded by the driving operation of the twisted elastic member 38, the momentum of the vehicle is still adequate to permit the same to coast forwardly an added distance without any tendency to wind the elastic member 38 in an opposite direction, for example, due to the weak spring 98 permitting ratcheting movement of the engageable ratchet elements of clutch 70, whereby the drive gear 66 is free to rotate with axle 34 while the transfer gear 54 is substantially idle and the rack 56 and drive shaft 44 likewise are idle.

Repeated pulling and pushing movements of the rack 56 will rapidly twist the elastic member 38 to the extent desired, followed by release of the same to effect forward driving of the toy vehicle. To further insure the movement of the second shaft 62 and the throwout gear 64 thereon forwardly for the purposes described above, the present invention includes a preferably stiff wire spring 102 preferably disposed adjacent the inner surface of one of the side plates 28 of supporting frame 26 as seen adjacent the left hand side of FIG. 4, the spring preferably being wound around a pin 104, shown in FIG. 5 and somewhat hidden behind the ring gear 52, and a leg 106 thereof abuts the bottom wall 108 of housing 20 as shown in FIG. 5. Also, as a further incidental advantage, the rearward end of the toothed sections of rack 56 is provided with an elongated notch 110 of limited length which, when the rack 56 is fully projected into the body of the vehicle will be disposed directly beneath the driving pinion 60 for purposes of preventing a lockup between the rack and driving pinion when rearward or extended movement of the rack 56 is initiated from a fully inserted position.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A toy automobile comprising in combination, a body, an axle supporting a pair of freely rotatable wheels adjacent one end of said body and a second axle having a pair of wheels fixed thereto and connected to the opposite end of said body to drive the same, the improvement comprising motor means to drive said second axle and including, an elongated elastic member connected at one end to fixed means adjacent one end of said body and the opposite end being connected to a winding mechanism comprising; an elongated rack supported within said body for longitudinal reciprocating movement in opposite directions relative to said body and winding mechanism, a gear train mounted within a supporting frame in said body and including a drive gear fixedly connected to said second axle and a driven gear in the train connected to a short drive shaft mounted axially in said supporting frame and parallel to said rack and having means on one end connected to said opposite end of said elastic member, a throwout gear operable relative to said rack and mounted for engagement and disengagement with said drive gear, and transfer gear freely rotatable on said second axle and meshing with said driven gear, and a clutch mounted between said drive gear and transfer gear and having engageable ratchet teeth thereon operable when said rack is pulled outwardly to engage each other and drive said drive shaft to wind said elastic member and when said rack is pushed into said body said throwout gear is moved by said rack to disengage said drive gear, while said drive shaft remains stationary to retain said elastic member against unwinding.

2. The toy automobile according to claim 1 in which said driven gear is a ring gear and said transfer gear also is axially movable upon said second axle a limited amount to permit said clutch members to ratchet after the twisted elastic member has unwound sufficiently to no longer provide driving force, whereupon the momentum of the automobile can continue to coast without any tendency to rewind the elastic member in a direction opposite to that in which it is wound to energize it due to the ratcheting of said clutch members.

3. The toy automobile according to claim 2 further including a relatively weak compression spring on said second axle operable to lightly engage said transfer gear to urge the ratchet teeth thereon comprising a clutch member toward the ratchet teeth on the drive gear which comprise the other clutch member, and said transfer gear being sufficiently wide to insure engagement of the teeth thereof with said ring gear at all times.

4. The toy automobile according to claim 1 further including stop means for said second axle comprising a manually operable lever pivotally supported within the body of the automobile and having a handle projecting outwardly from said body, and the opposite end being releasably engageable with a notched ratchet type rotary stop member fixed to said second axle and spring-pressed into engagement with the notches of said stop member, whereby when said rack is pulled to wind said elastic member the second axle is rotated reversely to forward driving direction while said stop member ratchets, and when said rack is pushed inwardly the second axle is held against rotation.

5. The toy automobile according to claim 4 further including latching detent means on said handle end of said lever operable to hold said lever in retracted position in which said opposite end is disengaged from said notched stop member on said second axle, thereby to maintain said opposite end in such disengaged position when the twisted elastic member is driving the automobile forwardly.

6. The toy automobile according to claim 1 in which said supporting frame for said gear train comprises a pair of parallel side plates fixed relative to said body adjacent said second axle and said side plates having axially aligned bearings for said second axle to rotatably support the same, said side plates also having short slots in alignment in a transverse direction parallel to said second axle, and a second shaft extending between said side plates and the opposite ends of said shaft respectively being disposed in said slots which extend substantially parallel to said rack, said throwout gear being fixed to said shaft within a plane common with said drive gear; and a pinion gear engageable directly with said rack and fixed to said second shaft adjacent said throwout gear, whereby when said rack is pulled outwardly from said body the engagement of said pinion gear with said rack causes rotation thereof in a direction to urge said shaft toward the rearward ends of said slots and engage said throwout gear with said drive gear, and when said rack is pushed into said body the engagement of said pinion gear with said rack causes said second shaft to move to the forward ends of said slots and thereby disengage said throwout gear from said drive gear.

7. The toy automobile according to claim 6 in which said supporting frame also has parallel end plates adjacent and connected to the opposite ends of said side plates and having openings therein through which said rack extends for guided movement while said rack is engaged by said pinion gear to maintain said rack slideable relative to one edge of each of said openings.

8. The toy automobile according to claim 7 including another supporting plate parallel to one of said end plates and spaced therefrom, and said plates having axially aligned bearings therein rotatably receiving spaced portions of said short drive shaft.

9. The toy automobile according to claim 6 further including spring means supported adjacent said supporting frame and operable to engage said second shaft and urge the same toward said forward ends of said slots to dispose said throwout gear in disengaged position relative to said drive gear.

10. The toy automobile according to claim 6 said body comprises shell members connected together and further including a housing within said body at least having side walls between which said supporting frame is mounted, said side walls of said housing having bearing openings and short slots axially aligned with the bearings and short slots of the side plates of said supporting frame, and said housing having means connecting the same to one of said shell members of said body.

* * * * *